US011975255B2

(12) United States Patent
Inoue

(10) Patent No.: US 11,975,255 B2
(45) Date of Patent: May 7, 2024

(54) GOLF PRACTICE TOOL

(71) Applicant: Shin Inoue, Hiratsuka (JP)

(72) Inventor: Shin Inoue, Hiratsuka (JP)

( * ) Notice: Subject to any disclaimer, the term of this patent is extended or adjusted under 35 U.S.C. 154(b) by 0 days.

(21) Appl. No.: 18/325,827

(22) Filed: May 30, 2023

(65) Prior Publication Data

US 2023/0321511 A1 Oct. 12, 2023

Related U.S. Application Data

(63) Continuation of application No. PCT/JP2021/043524, filed on Nov. 29, 2021.

(30) Foreign Application Priority Data

Dec. 1, 2020 (JP) ..... 2020-199940

(51) Int. Cl.
*A63B 69/36* (2006.01)

(52) U.S. Cl.
CPC ..... *A63B 69/3632* (2013.01); *A63B 69/3667* (2013.01)

(58) Field of Classification Search
CPC ..... A63B 69/3632; A63B 69/3667
USPC ..... 473/219, 226, 238, 257
See application file for complete search history.

(56) References Cited

U.S. PATENT DOCUMENTS 4,789,158 A * 12/1988 Chiesa ..... A63B 69/3632 473/238
4,953,867 A * 9/1990 Rigsby ..... A63B 69/3685 473/238
5,178,394 A * 1/1993 Tanampai ..... A63B 69/3638 473/238
5,605,509 A * 2/1997 Gray ..... A63B 69/3632 473/238
6,058,691 A * 5/2000 Greeves ..... A63B 57/50 56/400.04
6,238,299 B1 5/2001 Barnette
6,881,156 B1 4/2005 Phillips
7,059,970 B1 * 6/2006 Hamburger ..... A63B 69/3685 473/226
7,258,622 B1 * 8/2007 Gaviria ..... A63B 69/3632 473/226

(Continued)

FOREIGN PATENT DOCUMENTS

FR 2768063 A1 3/1999
JP 149720/1984 5/1986

(Continued)

*Primary Examiner* — Nini F Legesse
(74) *Attorney, Agent, or Firm* — EIP US LLP

(57) ABSTRACT

A golf practice device is disclosed to derive a proper stance and swing form of a golf club. The device to be installed on a shaft of a golf club with a club head, comprises a fixing part to be installed on the shaft and including a bearing part formed at a part thereof, and a shaft part to be fitted in the bearing part. In a state where a longitudinal direction of the shaft is horizontalized and a toe side of the club head is located on a ground side, the fixing part is installed at a center of gravity position of the entire golf club, on the shaft, and one end in an opposite side of the bearing part in the longitudinal direction, of the shaft part faces a vertical direction with respect to the longitudinal direction of the shaft to point a core of the golf club.

1 Claim, 17 Drawing Sheets

(56) References Cited

U.S. PATENT DOCUMENTS

| | | | | |
|---|---|---|---|---|
| 7,914,389 | B2 * | 3/2011 | Burns | A63B 69/3685 473/226 |
| 8,388,460 | B1 * | 3/2013 | Schantz | A63B 69/3685 473/238 |
| 9,333,408 | B1 * | 5/2016 | Hedrick | A63B 69/3632 |
| 2016/0008691 | A1 * | 1/2016 | Strano | A63B 69/3685 473/238 |

FOREIGN PATENT DOCUMENTS

| | | | |
|---|---|---|---|
| JP | 62-186877 | A | 8/1987 |
| JP | 7-194754 | A | 8/1995 |
| JP | 2006-326269 | A | 12/2006 |
| JP | 2008-188410 | A | 8/2008 |
| JP | 2008279230 | A | 11/2008 |
| JP | 3174076 | U | 2/2012 |
| JP | 61-65974 | S | 7/2017 |

* cited by examiner

GOLF PRACTICE TOOL

CROSS-REFERENCE TO RELATED APPLICATIONS

This application is a continuation under 35 U.S.C. § 120 of International Application No. PCT/JP2021/043524, filed Nov. 29, 2021, which claims priority to Japanese Patent Application No. 2020-199940, filed Dec. 1, 2020, under 35 U.S.C. § 119(a) now Japanese Patent JP7217041B2. Each of the above-referenced patent applications is incorporated by reference in its entirety.

BACKGROUND OF THE INVENTION

Field of the Invention

The present invention relates, for example, to products and the like related to golf, and in particular to golf practice tool.

Description of the Related Technology

In general, golf is a game hitting a stationary ball and making it fly. At first glance, it may seem easy, but hitting a stationary ball itself is of course not easy, much less it requires the most difficult technique to fly it straight as you wish. As a result, many golfers find that the direction in which the golf ball flies varies, and the number of shots increases. In order to improve it, they are making efforts to improve by going to the driving range, reading instruction books, and working with a teaching professional.

However, no matter how hard you try, it is extremely difficult to truly master the game, and even if you think you have improved for a time, you are back to your old ways, and the reality is that the average golfer cannot get good at it even after many years of repetition. Generally speaking, a score of less than 100 is the best that can be achieved with considerable effort on an 18-hole par-72 course, and to get a score of less than 90 or even 80 from there would require a tremendous amount of practice and time.

When we think about why golf is such a difficult sport, the fundamental cause of the difficulty can be found in the form of the golf club itself. In comparison to a baseball bat, in the case of a baseball bat, the position called the core is located inside the object of the bat, whereas in the case of a golf club, the part of the golf club that is the core of a baseball bat is not located inside the object of the golf club, but the core of a golf club is located in the space around the overlap between the vertical line from the center of gravity of the entire golf club on the shaft when the longitudinal direction of the golf club shaft is horizontal and the vertical line from the center of gravity of the entire golf club on the club head when the longitudinal direction of the golf club shaft is roughly vertical to the ground. (see FIG. 14)

Furthermore, when viewed from above and below, a baseball bat is symmetrical with concentric circles, whereas a golf club has a completely non-uniform structure, so it cloud happen that you can hit a moving ball with a baseball bat, but you cannot hit a stationary ball with a golf club.

Here, various technologies related to golf practice tool have been proposed. One of the technologies related to golf practice tool is an attachment to a shaft with an awareness of the center of gravity. For example, there are documents disclosing the technology related to golf practice tool, such as Patent Documents JP 2006-326269 and JP 2008-188410.

That is, the invention described in the Patent Document JP 2006-326269 focuses on the center of gravity of the golf club head, and since the tip of the shaft of the original golf club is not in a position where it points to the center of gravity of the club head, another shaft, called a virtual shaft, is added to the shaft of the golf club, and the tip of the shaft extends from the hand to a position near the center of gravity of the club head face, that is the basis of the invention.

On the other hand, the invention described in Patent Document JP 2008-188410 basically relates to a virtual shaft similar to the one described in Patent Document JP 2006-326269 above, and the difference from the above Patent Document JP 2006-326269 is that the golf club has two centers of gravity, the center of gravity of the club head and the center of gravity of the entire golf club, and the tip of the virtual shaft in the above Patent Document JP 2006-326269 extended to a position near the center of gravity of the face of the club head, but it is kept near the center of gravity of the entire golf club and its extended line points near the center of gravity of the club head as in the above Patent Document JP 2006-326269. The center of gravity of the entire golf club is said to be located on the club head side from the center of the club shaft described in paragraph 0002 of the same document, and at the part of the club shaft shown in FIG. 1 of the same document.

SUMMARY

However, the sport of golf is a very delicate sport, and if you swing with a device such as a virtual shaft attached, which would obviously affect the weight of the original golf club, that alone would throw the balance off and cause a different feeling of discomfort than actually hitting the ball with the original golf club. Therefore, in practice, after practicing swings by integrating such a virtual shaft with the original shaft and focusing on and being aware of the center of gravity of the virtual shaft and club head, it is considered to be less effective in increasing the meet rate if the invention described in Patent Document JP 2006-326269 or JP 2008-188410 above is removed and the ball is hit with a golf club with only the original shaft.

Furthermore, since golf clubs differ in weight, length, shape, and weight balance due to these factors in all numbers, if such a virtual shaft is attached to an actual golf club, the weight balance will be increasingly different for each number, which may result in amplifying a sense of discomfort.

The present invention was made in view of the above-mentioned problems, the object of which is to realize practice that enables players to acquire the proper stance (address) and swing form of a golf club without having to go to an actual golf course, as long as they have a space where they can swing a golf club, without spending an enormous amount of practice time and practice volume.

In order to solve the above problem, a golf practice tool according to an aspect of the invention is a golf practice tool to be attached to a shaft of a golf club equipped with a club head, which is attached to the shaft and has a fixing part with a bearing portion formed in part and a shaft part fitted to the bearing portion. With the shaft is horizontal in the longitudinal direction and the toe side of the club head positioned on the ground side, the fixing part is mounted at the center of gravity of the entire golf club on the shaft, and one end of the shaft part longitudinally opposite to the bearing portion is pointing vertically downward for the shaft longitudinal direction, so that characterized by pointing to the core of the golf club.

In this aspect, the core of the golf club may be characterized as the space around the overlap of the vertical line from the center of gravity of the entire golf club on the shaft when the longitudinal direction of the shaft is made horizontal and the vertical line from the center of gravity of the entire golf club on the club head when the longitudinal direction of the shaft of the golf club is made roughly vertical to the ground.

It may also be characterized that the fixing part and the shaft part are formed as an integral and indivisible part.

The shaft part may be as thick or as narrow as the diameter of the shaft.

The fixing part may be fixed to the shaft so that the longitudinal direction of the shaft may be rotated around the axis.

The longitudinal length of the shaft part may be characterized as 3 cm or more and 8 cm or less.

It may also feature that the thickness of the shaft part can be selected according to the user's proficiency in golf skills.

In another aspect, a golf practice tool to be attached to a shaft of a golf club with a club head, which is attached to the shaft and has a fixing part with a bearing portion formed in part, and five shaft parts fitted to the bearing portion, wherein the center shaft part of the five shaft parts is provided perpendicular to the longitudinal direction of the shaft, and the five shaft parts are on the same plane, the angular difference from the center line of the five adjacent shaft parts is 10 degrees each, and when the longitudinal direction of the shaft is made horizontal and the toe side of the club head is positioned on the ground side, the fixing part is mounted at the center of gravity of the entire golf club on the shaft, and one end of the shaft at the center of the five shaft parts, opposite to the bearing portion in the longitudinal direction, may point vertically downward to the longitudinal direction of the shaft and point to the core of the golf club.

In this aspect, the core of the golf club may be characterized as the space around the overlap of the vertical line from the center of gravity of the entire golf club on the shaft when the longitudinal direction of the shaft is made horizontal and the vertical line from the center of gravity of the entire golf club on the club head when the longitudinal direction of the shaft is made roughly vertical to the ground.

In addition, the fixing part and the shaft part may be formed as an integral and indivisible part.

In addition to this, the golf practice tool may be integrally formed with the golf club.

Advantageous Effects of the Invention

According to the present invention, it is possible to derive the proper golf club stance (address) and swing form without spending an enormous amount of time and practice as long as there is space to swing a golf club without having to go to the actual golf course. As a result, the face of the club head and the golf ball hit each other accurately, and the player can develop a sense of the optimum shot, thereby reducing the number of shots and improving the score.

DETAILED DESCRIPTION OF CERTAIN INVENTIVE EMBODIMENTS

One embodiment of the invention is described below with reference to the drawings.

First Embodiment

Figure 1:
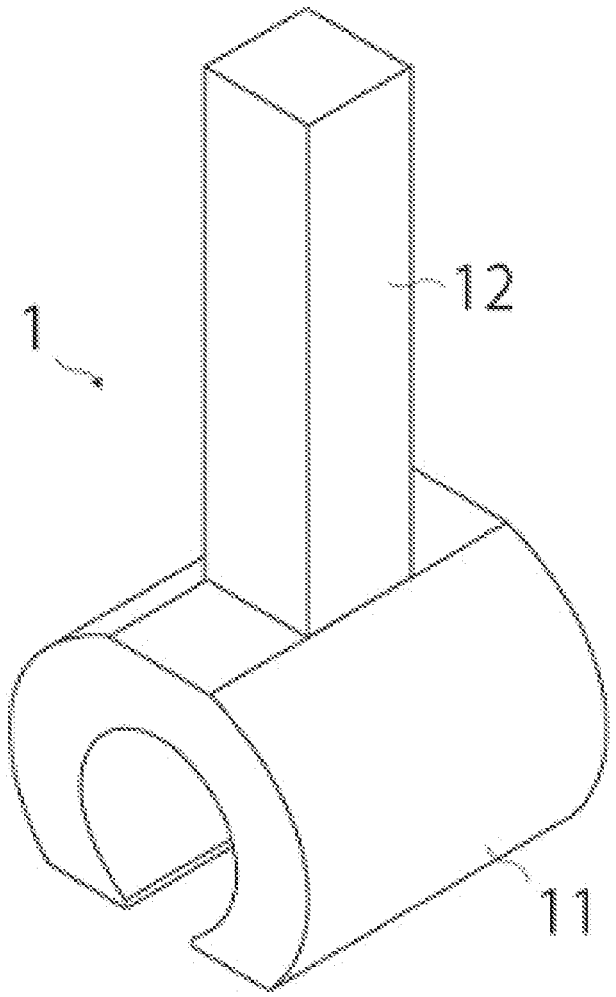
FIG. 1 is an overall oblique view of the golf practice tool of the first embodiment of the present invention.
Figure 2:
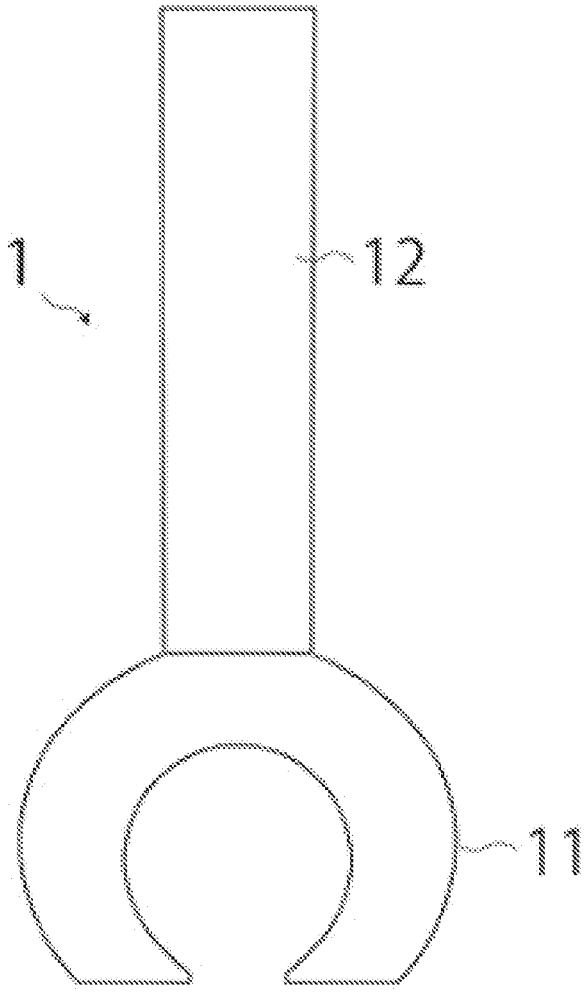
FIG. 2 is a front view of the golf practice tool.
Figure 3:
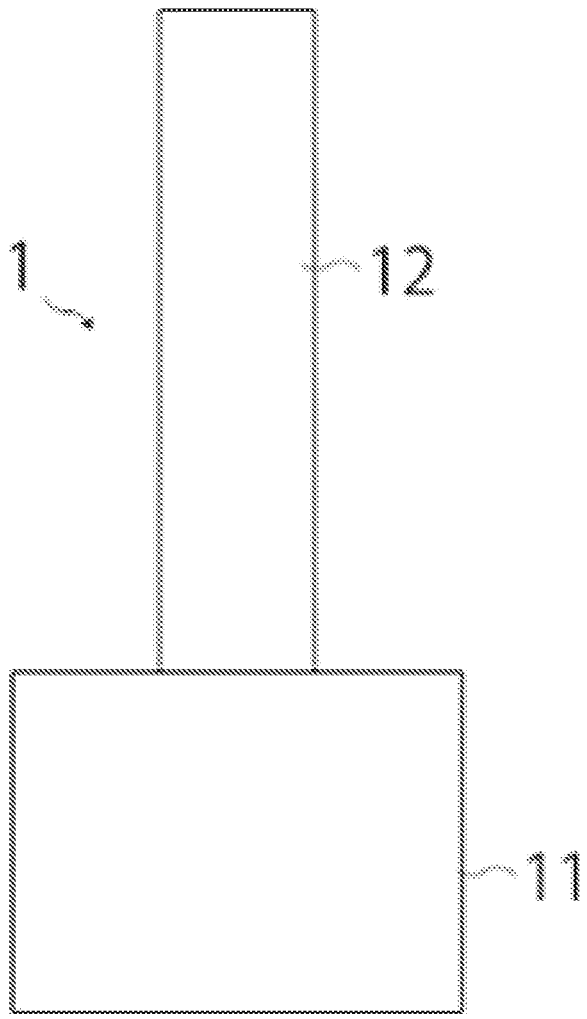
FIG. 3 is a side view of the golf practice tool.
Figure 4:
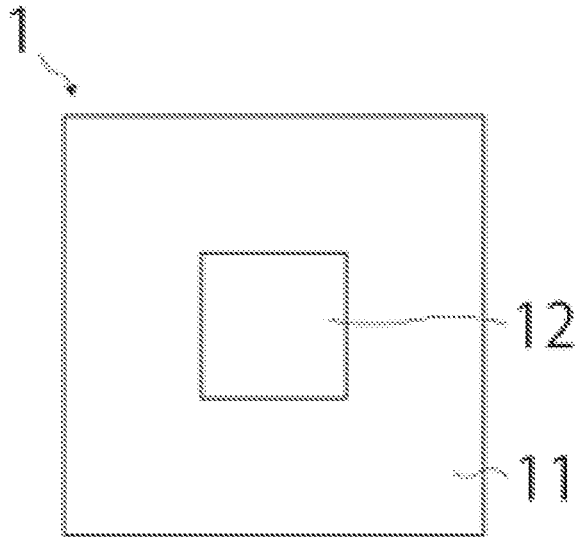
FIG. 4 is a plan view of the golf practice tool.
Figure 5:
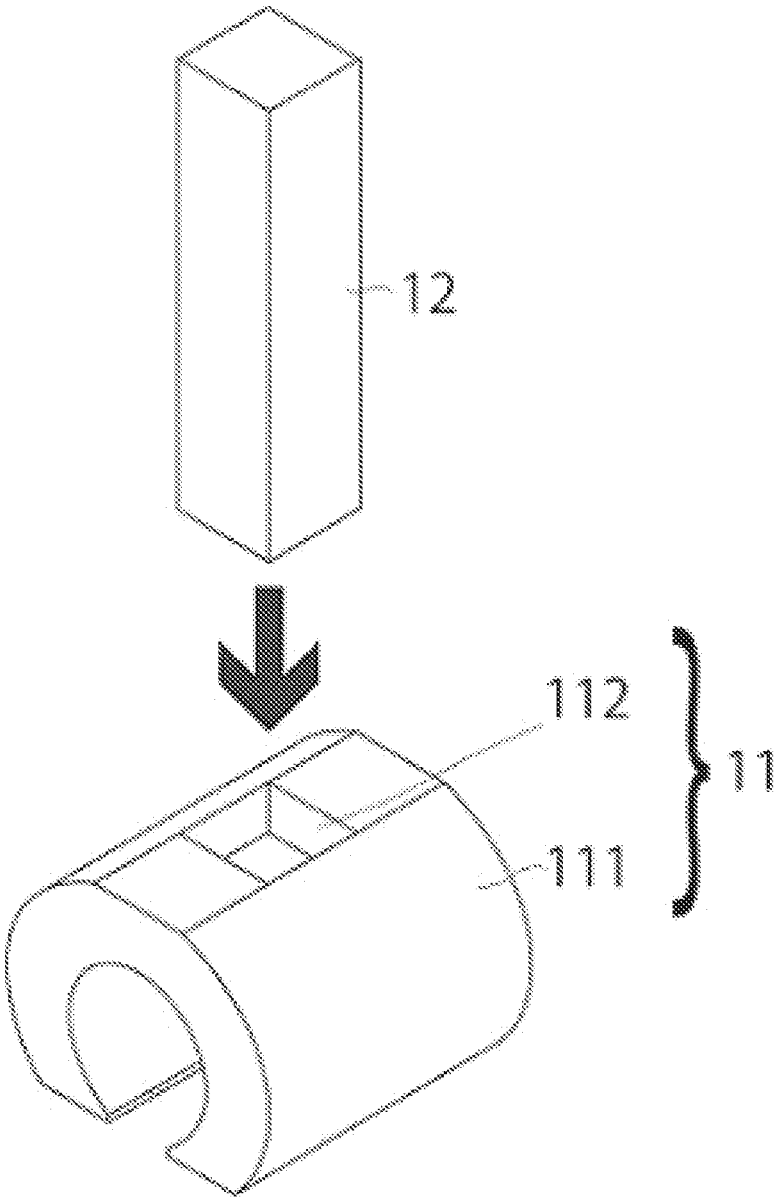
FIG. 5 is an exploded perspective view of the golf practice tool.

FIG. 1 shows an overall oblique view of the golf practice tool concerning the first embodiment of the invention, FIG. 2 shows a front view of the golf practice tool, FIG. 3 shows a side view of the golf practice tool, FIG. 4 shows a plan view of the golf practice tool, and FIG. 5 shows an exploded perspective view of the golf practice tool.

As shown in these figures, the golf practice tool 1 comprises a fixing part 11 for fixing to the shaft 22 of a golf club, and a shaft part 12

The fixing part 11 comprises a pincer portion 111 and a bearing portion 112, as shown in FIG. 5. The pincer portion 111 is roughly C-shaped, as shown in FIG. 2.

In the center of the other end face of the fixing part 11, opposite to the side where the pincer portion 111 is formed, a bearing portion 112, a groove for attaching the shaft part 12, is formed.

Shaft part 12 consists of a square prism. One end of the shaft part 12 in the longitudinal direction can be pushed into the bearing portion 112 and fitted perpendicular to the push-in plane to be integrated.

The Shaft 22 is common, e.g., made of steel.

Referring to FIG. 4, the length and width of the fixing part 11 is, for example, 1.0 cm to 3.0 cm. Referring to FIG. 3, the height of the fixing part 11 is, for example, 1.0 cm to 3.0 cm. The longitudinal length of the shaft of the shaft part 12 is, for example, 3 cm to 8 cm. The thickness (width) of the shaft part 12 is the same as or smaller than the diameter of the shaft 22. The diameter of the opening of the C-shaped inner surface of the pincer portion 111 is, for example, 0.7 cm to 1.5 cm.

The fixing part 11 and the shaft part 12 are elastic (e.g., synthetic rubber). Therefore, by pushing the shaft 22 through the C-shape of the pincer portion 111, the pincer portion 111 is elastically deformed, the C-shape of the pincer portion 111 is pushed outward from inside, the shaft 22 passes through the C-shape of the pincer portion 111, and the elastic deformation returns, thus the shaft 22 is held and fixed in place. Once the fixing part 11 is fitted to the shaft 22, the golf practice tool 1 can be rotated around the longitudinal axis of the shaft 22 by pushing outward from the inside between the C-shape of the pincer portion 111 with fingers or by applying some force in the rotational direction. Furthermore, in the same way, the golf practice tool 1 can be slid back and forth along the longitudinal direction of the shaft 22.

The weight of the golf practice tool 1 is, for example, 10 g to 30 g when manufactured by molding synthetic rubber.

Figure 6:
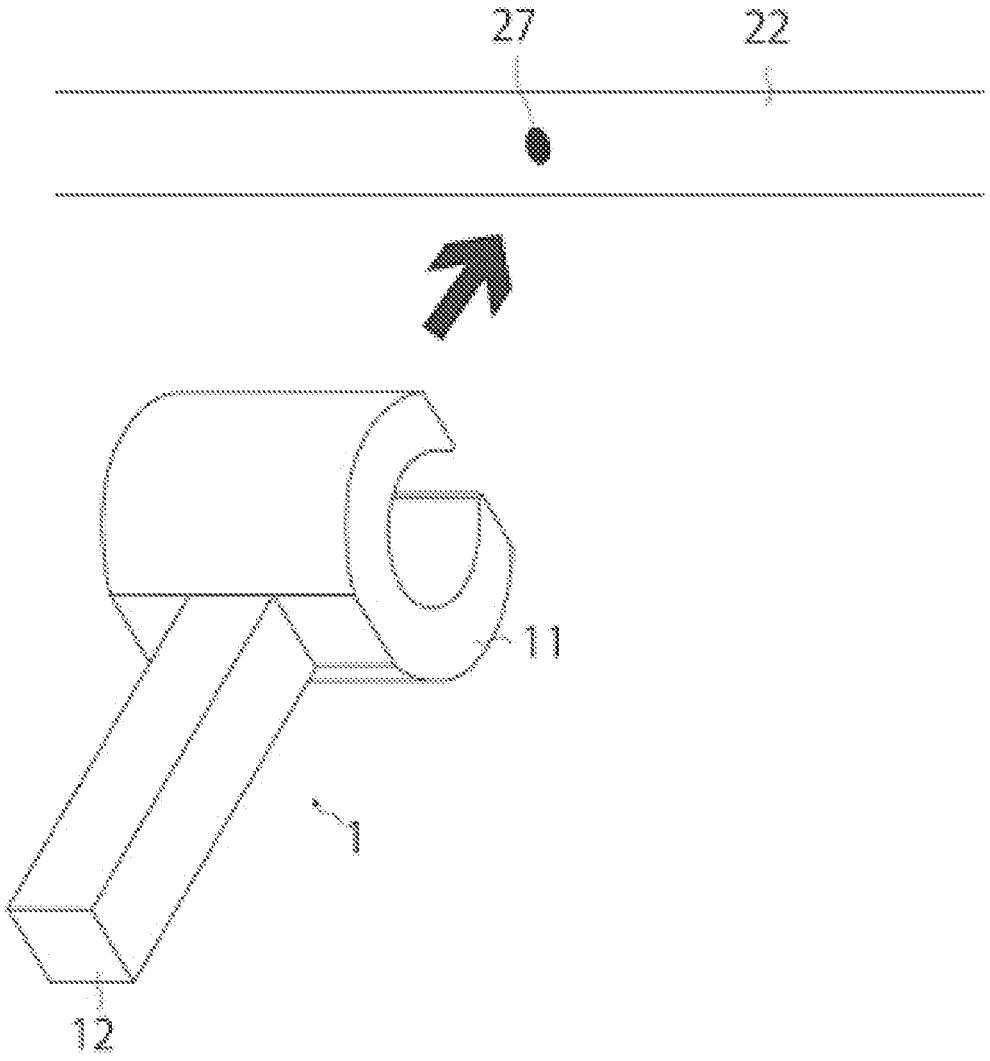
FIG. 6 is a view showing the mounting of the golf practice tool.
Figure 8:
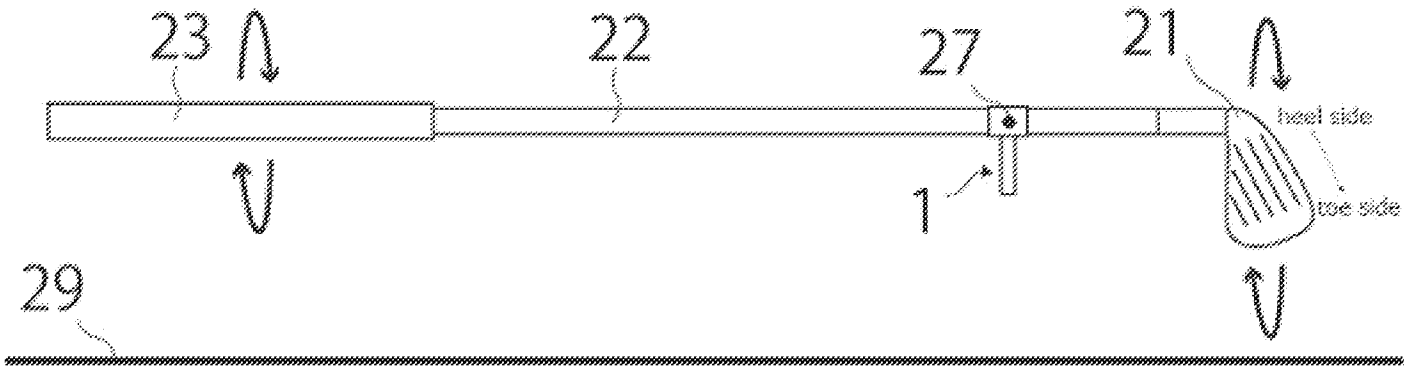
FIG. 8 illustrates how the toe side of the club head is positioned toward the ground as the club head pivots toward the ground due to the weight of the club head itself.

In the present embodiment, the shaft part 12 is fitted and integrated into the bearing portion 112, and the golf practice tool 1 is attached to the center of gravity 27 of the entire golf club on the shaft 22 as shown in FIG. 6. As shown in FIG. 8, when the longitudinal direction of shaft 22 is horizontal, the toe side of club head 21, relative to shaft 22, is positioned on the ground side, attach the golf practice tool 1 so that one end of the shaft part 12 opposite the bearing portion 112 side in the longitudinal direction points vertically downward from the center of gravity of the entire golf club 27 on the shaft 22 to the longitudinal direction of the shaft 22.

By attaching the golf practice tool 1 to the center of gravity position 27 of the entire golf club on the shaft 22, the position of center of gravity of the entire golf club on the shaft 22 does not change when the golf practice tool 1 is not attached and when it is attached, so the balance of the entire golf club and swing sensation are less affected. Therefore, after the correct stance and swing form are established using the golf practice tool 1, you can swing in the same stance and with the same swing sensation even if you remove the golf practice tool 1, and you can make an accurate shot.

The following is a more specific explanation of how to attach the golf practice tool 1 to the center of gravity 27 of the entire golf club on the shaft 22, using the case of a right-handed golfer as an example.

First, to determine the center of gravity position 27 of the entire golf club on the shaft 22, hold the grip 23 with the left hand, and the right hand, for example, support the shaft 22 from below with the belly of the index finger of the right hand, so that the shaft 22 is horizontal in the longitudinal direction. Next, release the grip 23 from the left hand and use the belly of the index finger of the right hand as a fulcrum to check the position where the shaft 22 can be balanced horizontally in the manner of a balance. When the grip 23 is released from the left hand, if the toe side of the club head 21 is not positioned on the ground side in relation to the shaft 22, the weight of the club head 21 itself will cause the club head 21 to rotate about the longitudinal axis of the shaft 22 and the toe side of the club head 21 will be positioned on the ground. Once the shaft 22 is balanced horizontally and the center of gravity 27 of the entire golf club on the shaft 22 is known, the golf practice tool 1 with the shaft 12 fitted and integrated into the bearing portion 112 is fitted at the center of gravity.

Figure 7:
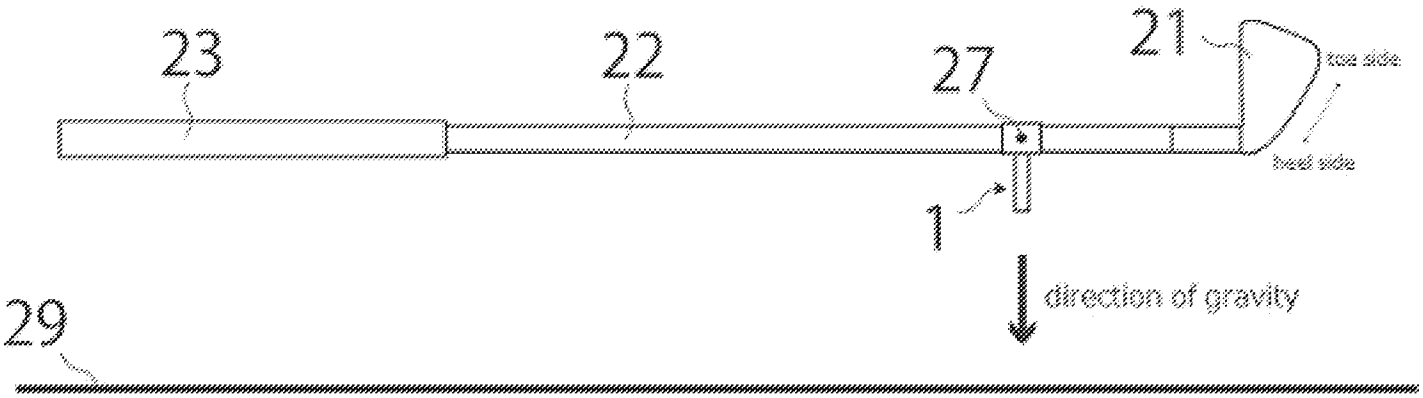
FIG. 7 illustrates the club with the golf practice tool and the direction of gravity.

Here, the toe side refers to one end of the club head 21 opposite the shaft 22 side in the longitudinal direction, as shown in FIGS. 7 and 8, and conversely, the heel refers to the other end of the club head 21 on the shaft 22 side in the longitudinal direction.

In the above explanation, in order to ascertain the center of gravity 27 of the entire golf club on the shaft 22, the grip 23 is held in the left hand and the shaft 22 is supported from below by the belly of the index finger of the right hand. However, since the head side is generally heavier than the grip side, the golf practice tool 1 can be fitted at any position closer to the head side than the center of the shaft 22 in the longitudinal direction, and you can hold the grip 23 with your left hand and attached golf practice tool 1 as other point in place of the index finger of the right hand. Then, release the grip 23 from the left hand and check the position where the shaft 22 can be balanced horizontally in the manner of a balance using the golf practice tool 1 as a fulcrum.

When balanced, the golf practice tool 1 would have been attached to the center of gravity 27 of the entire golf club on the shaft 22. Here, as in the case of the belly of the index finger of the right hand described above, when the grip 23 is released from the left hand, if, as shown in FIG. 7, the toe side of the club head 21 relative to the shaft 22, is not located on the ground side, since the golf practice tool 1 is attached to the shaft 22 in such a way that it can be rotated about the longitudinal axis of the shaft 22, if you release the grip 23 from your left hand, hold the golf practice tool 1 with your right hand only, and spread it slightly with your left fingers so that it pushes outward from the inside between the C-shape of the pincer portion 111, as shown in FIG. 8, the weight of the club head 21 itself causes the club head 21 to rotate about the longitudinal axis of the shaft 22, and the toe side of the club head 21 is positioned toward the ground by the weight of the club head 21 itself.

In both cases, using the belly of the index finger of the right hand and using the golf practice tool 1, the direction opposite the bearing 112 side of the shaft 12 of the golf practice tool 1 in the longitudinal direction points vertically downward to the shaft 22. Thus, the golf practice tool 1 will point to the core 33 of the golf club.

Figure 14:
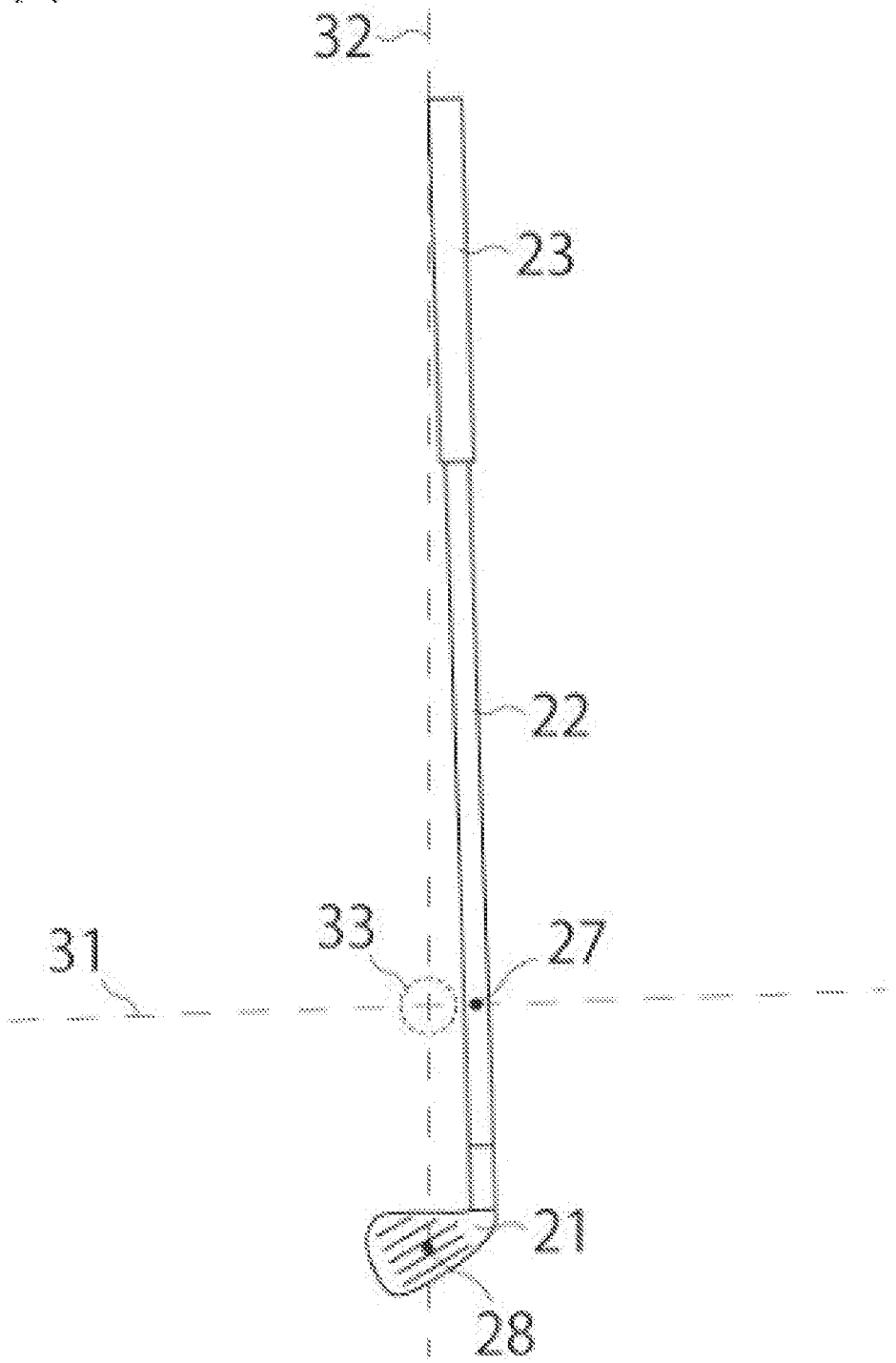
FIG. 14 shows the core that is the space around the overlap of the line of the center of gravity of the golf club when the golf club is horizontal and the line of the center of gravity of the golf club when the golf club is vertical.

Here, the core 33 of the golf club, as shown in FIG. 14, refers to the space around the intersection, or crossing without intersection, or overlap, of the vertical up-down line 31 from the center of gravity 27 of the entire golf club on the shaft 22 of the golf club when the longitudinal direction of the shaft 22 of the golf club is horizontal and the vertical up-down line 32 from the center of gravity 28 of the entire golf club on the club head 21 when the longitudinal direction of the shaft 22 of the golf club is perpendicular to the ground.

On the other hand, if the golf practice tool fails to balance, slide the golf practice tool 1 back and forth by applying some force along the longitudinal direction of the shaft 22 to put it in a position where it can balance.

Figure 9:
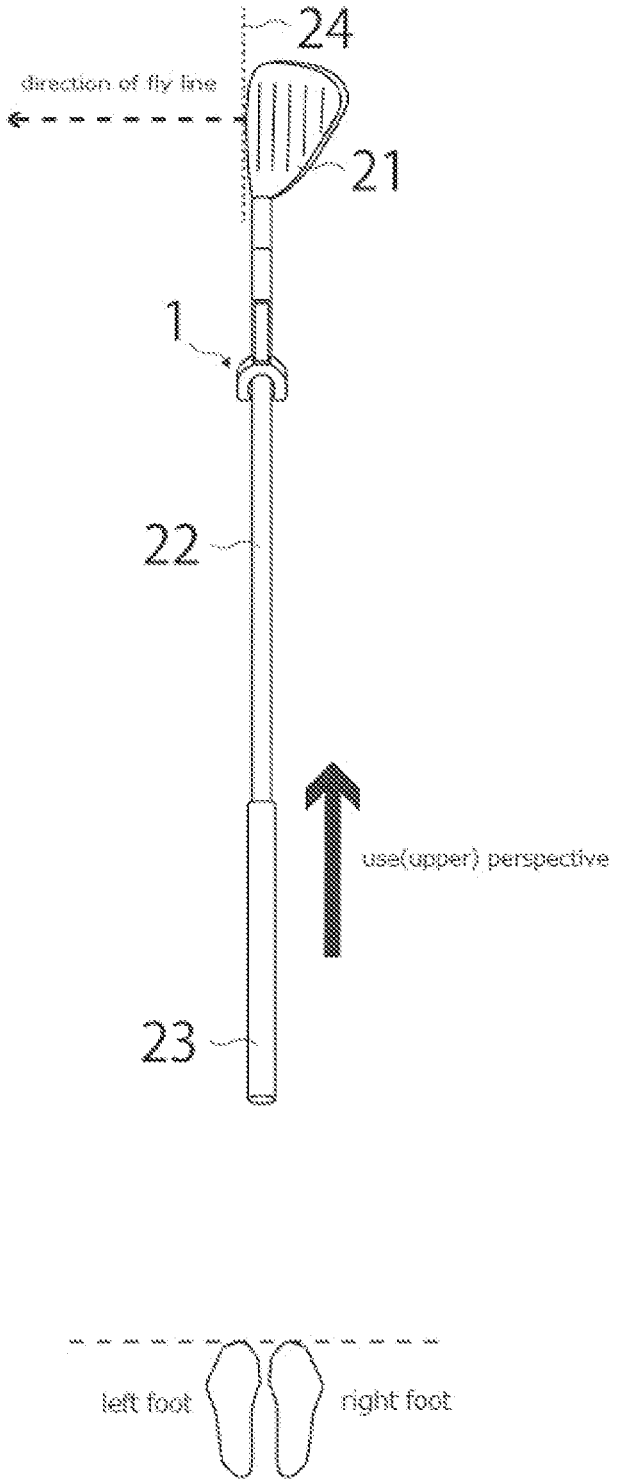
FIG. 9 is a view showing a golf club with the golf practice tool held with both legs closed.

FIG. 9 shows and describes the state holding a golf club with the golf practice tool 1 of the first embodiment of the invention.

Figure 11:
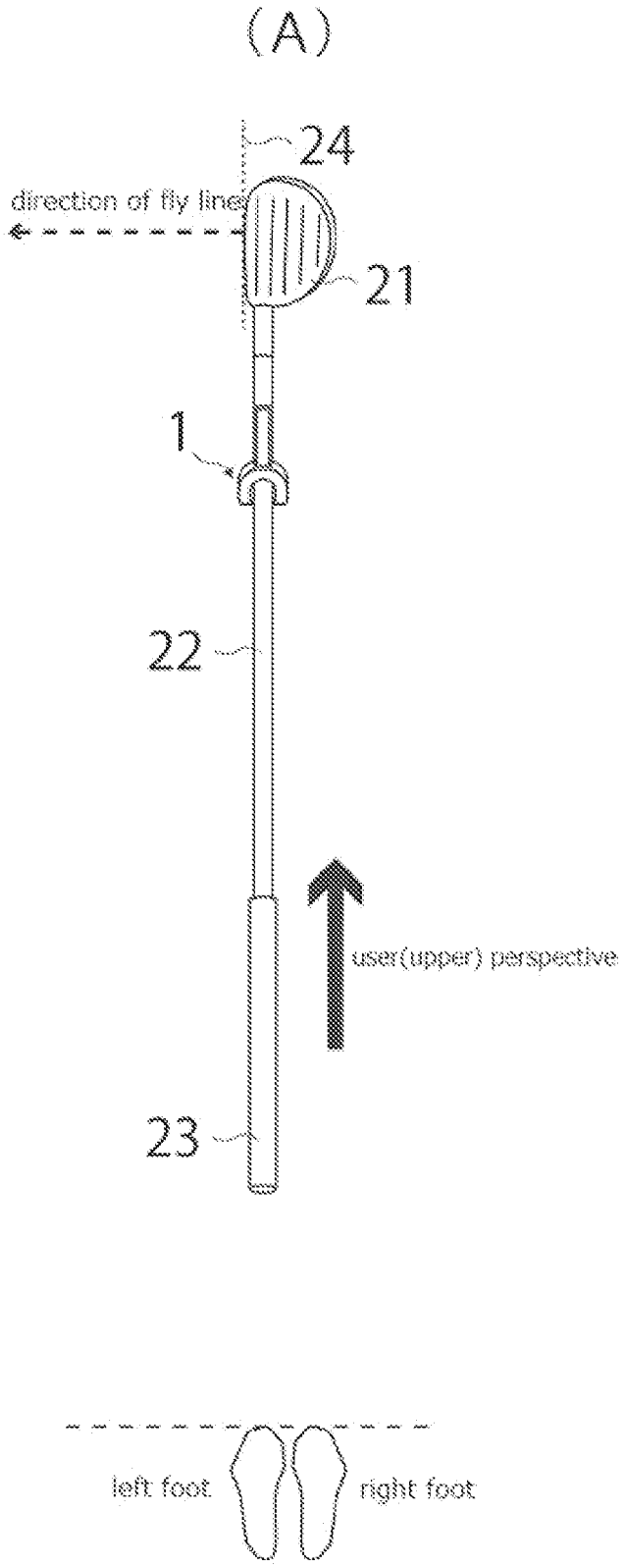
FIG. 11 shows the position of the grip in relation to the body in the case of driver (A) or wedge (B).
Figure 11:
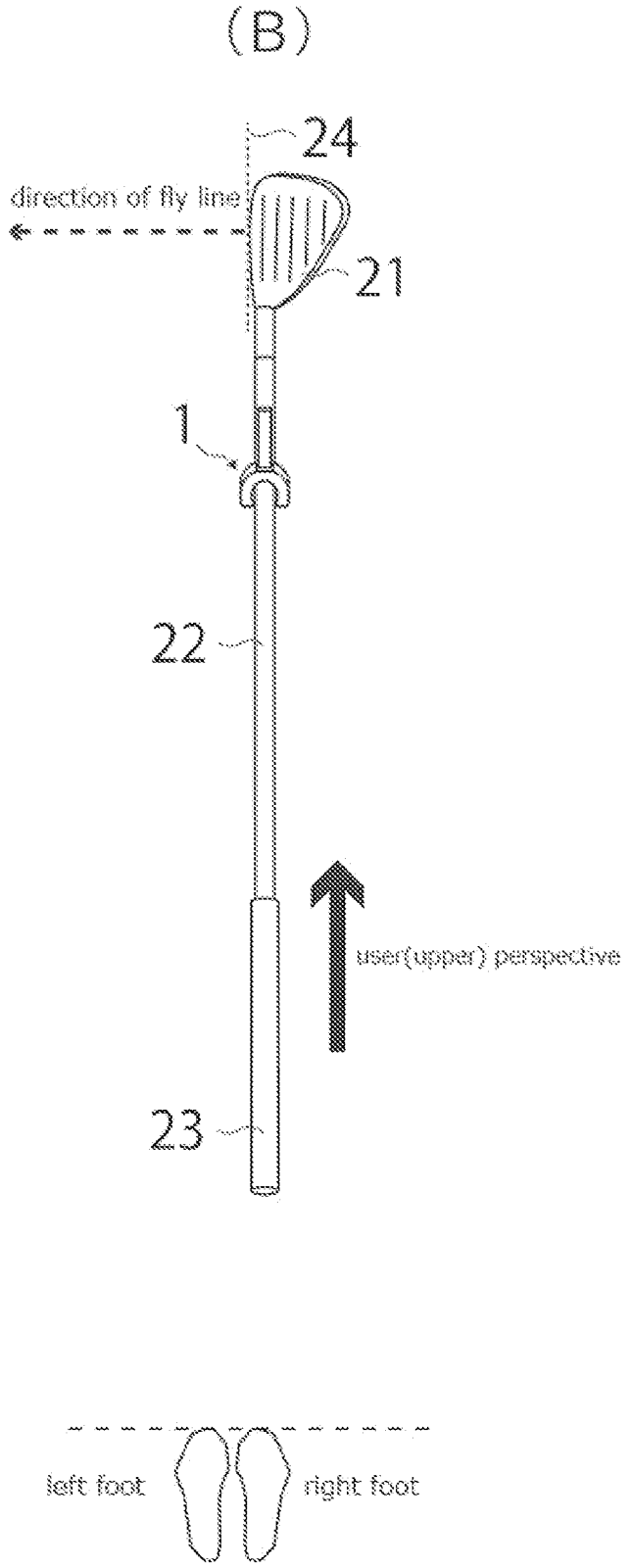

As shown in the figure, once the golf practice tool 1 is attached, place the club head 21 so that it faces forward with respect to the flying direction of the golf ball (so that the line 24 of the sole of the club head 21 is orthogonal to the line of the flying ball). With both feet together, grasp the grip 23 with either the left or right hand, not both hands, and from the user perspective, move the hands to align the grip 23 so that the entire shaft 12 of the golf practice tool 1 and shaft 22 overlap, or more specifically, so that the shaft 12 of the golf practice tool 1 fits within the width of shaft 22 as shown in the figure. The position of the grip 23 usually comes to the left relative to the body for a driver with a small loft angle as shown in FIG. 11(*a*), and to the right for a wedge with a large loft angle as shown in FIG. 11(*b*).

Figure 10:
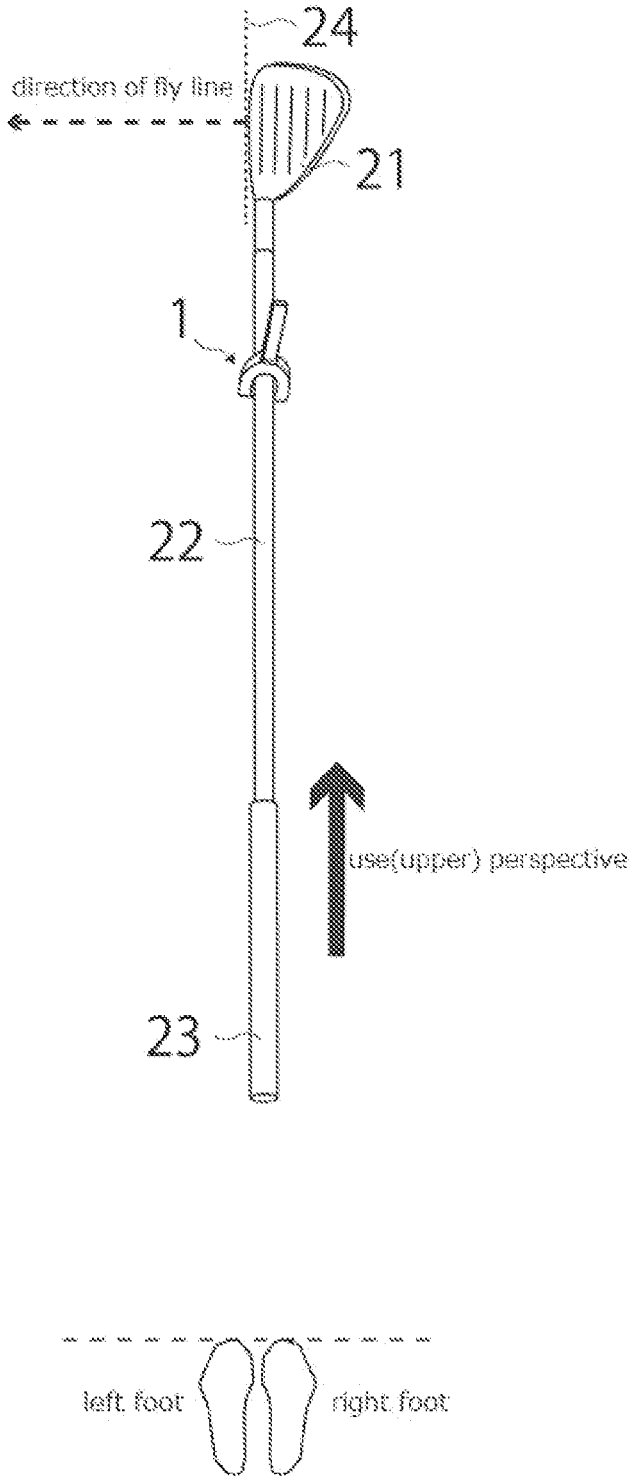
FIG. 10 is a view showing that the shaft part of the golf practice tool does not fit within the width of the shaft.

At this time, in order to check whether the position of the club head 21 and the grip 23 are appropriate, keep both feet closed together, grip accompanied with the other hand, fix the axis of the body so as not to move the head as much as possible, and make a back swing until the club head 21 is at knee height in a circular path, during which the entire shaft 12 and shaft 22 of the golf practice tool 1 should visually overlap. As shown in FIG. 10, from the user's perspective, if there is no overlap, shift the placement of the club head 21 to the left, right, up and down, back and forth, or adjust the grip 23, and again make a back swing until the club head 21 is at knee level, if, in the meantime, the position can be visually confirmed that the entire shaft 12 of the golf practice tool 1 and the shaft 22 overlap, then that confirmed position is the appropriate position to place the club head 21 and the appropriate position for the grip 23. Even if subtle adjustments are needed, the golf practice tool 1 can be rotated around the longitudinal axis of the shaft 22 so that the entire shaft 12 of the golf practice tool 1 and the shaft 22 overlap.

Figure 12:
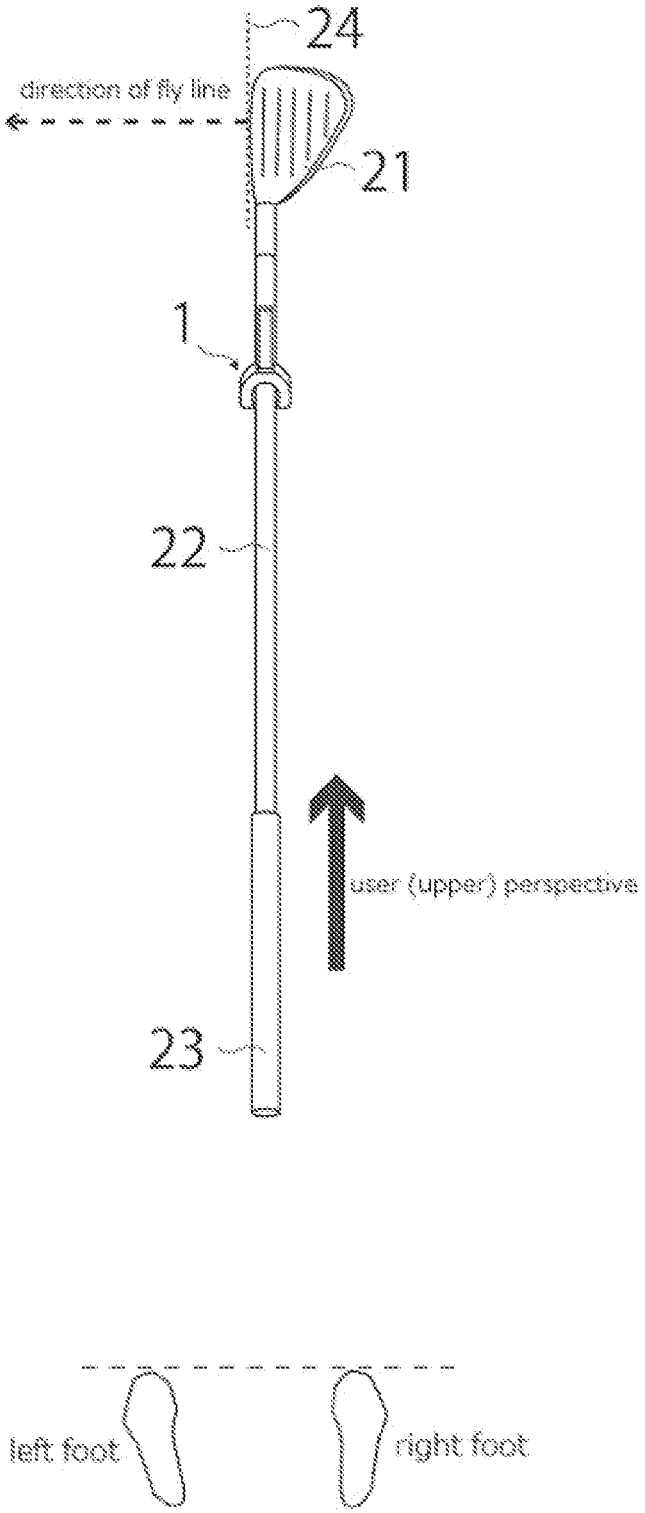
FIG. 12 shows a golf practitioner holding a golf club with golf practice tool and legs spread apart.

Once the position of the club head 21 and the position of the grip 23 are determined, as shown in FIG. 12, while confirming that the entire shaft part 12 of the golf practice tool 1 is overlapped with the shaft 22, the other hand is attached and gripped, and take a stance with both feet, which were closed, equally spread apart so that they are parallel to the flying ball line.

Figure 13:
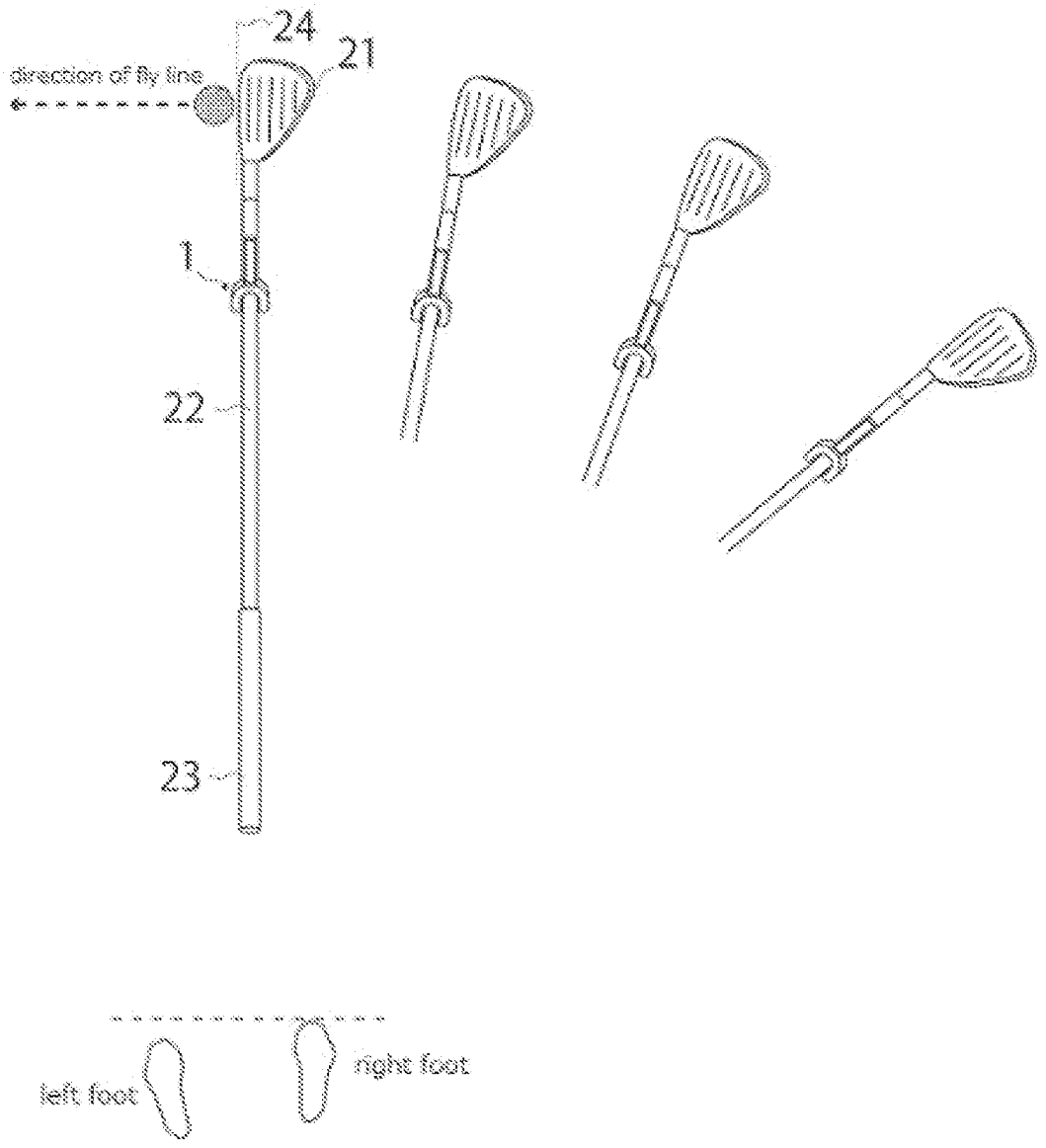
FIG. 13 shows the take-back of a golf club equipped with the golf practice tool.

Continue to back swing the golf club while visually confirming that the entire shaft part 12 of the golf practice tool 1 and the shaft 22 overlap, raise the golf club right side up to about knee height as shown in FIG. 13, then If the entire shaft part 12 of the golf practice tool 1 and the shaft 22 are displaced in line, take a stance with the right foot pulled from the line of flight to the so-called closed stance or the left foot pulled to the so-called open stance so that they overlap.

A closed stance is common when using a driver, an open stance is common when using a wedge iron, and for other clubs, there are in between, a square stance with toes of both feet parallel to the direction of the flying ball line with a 7-iron or 8-iron mid-iron, it is common for clubs with a smaller loft angle to have a slightly closed stance and clubs with a larger loft angle to have a slightly open stance. The reason why in common is that golf clubs vary in loft angle from manufacturer to manufacturer, even for the same club number, even if there are differences, if you visually confirm that the entire shaft part 12 of the golf practice tool 1 overlaps with the shaft 22 as described above, the stance of both feet will naturally be determined. Another feature of this golf practice tool is that it can be used with any golf club, regardless of the manufacturer of the golf club.

Once the stance and posture have been determined, visually, perform practice swing to the knees repeatedly, keeping in mind that the entire shaft part 12 of the golf practice tool 1 and the shaft 22 overlap. By getting a feel for this, the player can practice to improve the accuracy of hitting the golf ball accurately with the face of the club head 21. In this case, the golf practice tool may be removed before hitting the ball.

According to the first embodiment of the invention described above, a golf practice tool to be attached to a shaft 22 of a golf club equipped with a club head 21, having a fixing part 11 comprising a pincer portion 111 and a bearing portion 112 that clamps the shaft 22, and a shaft part 12 that is fitted to the bearing portion 112 and stands perpendicular to the longitudinal direction of the shaft 22, and a golf practice tool in which the fixing part 11 is mounted at the center of gravity of the shaft so that the entire shaft part 12 and the shaft 22 appear to overlap from the user's perspective at address is also provided as an aspect of the golf practice tool.

Second Embodiment

In the first embodiment described above, the golf practice tool 1 consisted of a fixing part 11 and a shaft part 12, but it differs in that the fixing part 11 and the shaft part 12 are formed as one piece. In this embodiment, the fixing part 11 and the shaft part 12 cannot be separated. This prevents the fixing part 11 or shaft part 12 from rolling around and getting lost. In addition, this embodiment has fewer components than the first embodiment, which is advantageous in terms of cost.

Thus, according to the first and second embodiment of the invention, the following effects are achieved.

First, the golf swing is subject to various unspecified factors such as body shape, body orientation, wrist angle, grip, and undulation of the ground on the actual golf course, but the golf practice tool 1 can be used as the only indicator to adjust the stance and swing. Specifically, if the ball flies hook or slice when the golf practice tool 1 is attached and hit the ball, do not change the longitudinal attachment position of the shaft 22, but rotate the golf practice tool 1 clockwise or counterclockwise around the longitudinal axis of the shaft 22, for example, at an angle of 3 to 5 degrees, and hit the ball in that state. By analyzing whether the golf ball was hit straight or how much of a hook or slice was applied, it is possible to determine how the golf practice tool 1 should be rotated next and how the stance should be adjusted based on that, and to use that as a factor in determining how to improve the swing.

Second, the golf practice tool 1 is mounted at the center of gravity 27 of the entire golf club on the shaft 22. Therefore, whether or not the golf practice tool 1 is attached to the shaft 22, the center of gravity position of the entire golf club on the shaft 22 remains the same, and so, it is less likely to affect the overall balance of the golf club and the sensation of swing due to wearing the golf practice tool 1. Therefore, after the correct stance and swing form have been established using the golf practice tool 1, even if the golf practice tool 1 is removed, the same posture and the same swinging sensation allow the player to swing and make an accurate shot.

Furthermore, the golf practice tool 1 is mounted at the center of gravity of the entire golf club 27 on the shaft 22, and the direction opposite to the bearing portion 112 side of the shaft 12 of the golf practice tool 1 in the longitudinal direction points vertically downward to the shaft 22. Therefore, the golf practice tool 1 will point to the core 33 of the golf club. Thus, the user can correct his posture and swing form without being aware of the core 33 of the golf club, but simply by being aware of the overlap of the entire shaft part 12 and shaft 22. The inventor tried with various golf clubs and confirmed that the direction pointed by the shaft part 12 of the golf practice tool 1 immediately after attaching the golf practice tool 1 to the center of gravity of the entire golf club 27 on the shaft 22, with the longitudinal direction of the shaft 22 horizontal, points to the core 33 of the golf club, especially for irons. In the case of a driver, with the longitudinal direction of the shaft 22 horizontal, to point to the center of gravity side of the driver head unit from the direction pointed by the shaft part 12 of the golf practice tool 1 immediately after attaching the golf practice tool 1 to the center of gravity of the entire golf club 27 on the shaft 22, by rotating shaft part 12 counterclockwise around the longitudinal axis of shaft 22 and adjusting its position appropriately, the inventor confirmed that the shaft part 12 points to the core 33 of the golf club and the swing is improved by using the overlap of the entire shaft part 12 and shaft 22 as an indicator. In addition, for the putter, by adjusting the stance using the direction of the shaft part 12 of the golf practice tool 1 as an indicator, the inventor confirmed that adjusting the posture has an effect.

Third, the golf practice tool 1 is fitted so that it can be rotated by applying some force in the rotational direction around the longitudinal axis of the shaft 22. Therefore, the longitudinal direction of the shaft 22 is horizontal, and the golf practice tool 1 is attached to the center of gravity 27 of the entire golf club on the shaft 22, if the toe side of the club head 21, relative to shaft 22, is not located on the ground side, when the golf practice tool 1 is slightly spread out with the fingers so as to push outward from inside to outside between the C-shape of the pincer 111, the toe side of the club head 21 can be positioned on the ground side by the weight of the club head 21 itself as the club head 21 rotating about the longitudinal axis of the shaft 22 without regard to differences in the product specifications of the golf club.

Fourth, after attaching the golf practice tool 1 to the shaft 22 of a golf club, the golf practice tool 1 can be rotated around the longitudinal axis of the shaft 22, so the pointing direction of the shaft part 12 of the golf practice tool 1 can be changed without detaching the golf practice tool 1. Accordingly, the pointing direction can be easily fine-tuned to improve the swing.

Fifth, the golf practice tool 1 is fitted so that it can slide back and forth by applying some force along the longitudinal direction of the shaft 22. Therefore, when looking for the center of gravity 27 of the entire golf club on the shaft 22 with the golf practice tool 1 attached, the golf practice tool 1 can be easily set at the center of gravity 27 of the entire golf club on the shaft 22 without having to bother to remove the golf practice tool 1 from the shaft 22.

The first and second embodiment of the invention have been described above. However, the invention is not limited thereto, and various improvements and modifications are possible without departing from the intent of the invention.

For example, in the first and second embodiment above, the fixing part 11 and shaft part 12 are elastic (e.g., synthetic rubber), but they can be made of silicone, synthetic resin, etc., for example, if they are fixed to the shaft 22 and the mounting position can be changed without detaching.

The pincer portion 111 of the first and second embodiment of the present invention may, for example, has a structure similar to that of the scissors portion of a clothespin.

The fixing part 11 of the first and second embodiment of the present invention does not have to be a pincer, but can be fixed to the shaft 22. For example, it may be fixed using adhesive tape.

The shaft part 12 may have a taper shape at one end in the longitudinal direction. The shaft part 12 may be not limited to quadrangular prism, but may be cylindrical.

The bearing portion 112 can be a hole as well as a groove.

In order to increase the accuracy of the alignment and overlap of the shaft 22 and shaft part 12, the thickness (width) of the shaft part 12 of the golf practice tool 1 may be selected and interchangeable, depending on the user's proficiency in golf skills (For example, about 1 cm is for beginners, about 7 mm for intermediate, and about 3-4 mm for advanced).

The shape of the pincer portion 111 can be a roughly U-shape or a roughly O-shape with a slit as well as a roughly C-shape.

With regard to the O-shaped pincer portion, more specifically, a slit extending in the length direction of the shaft is formed on one end face of the pincer portion, and the slit of the pincer portion is placed against the shaft and pushed toward the shaft so that the shaft can push the slit of the pincer portion to expand the slit and cover the shaft.

Figure 15:
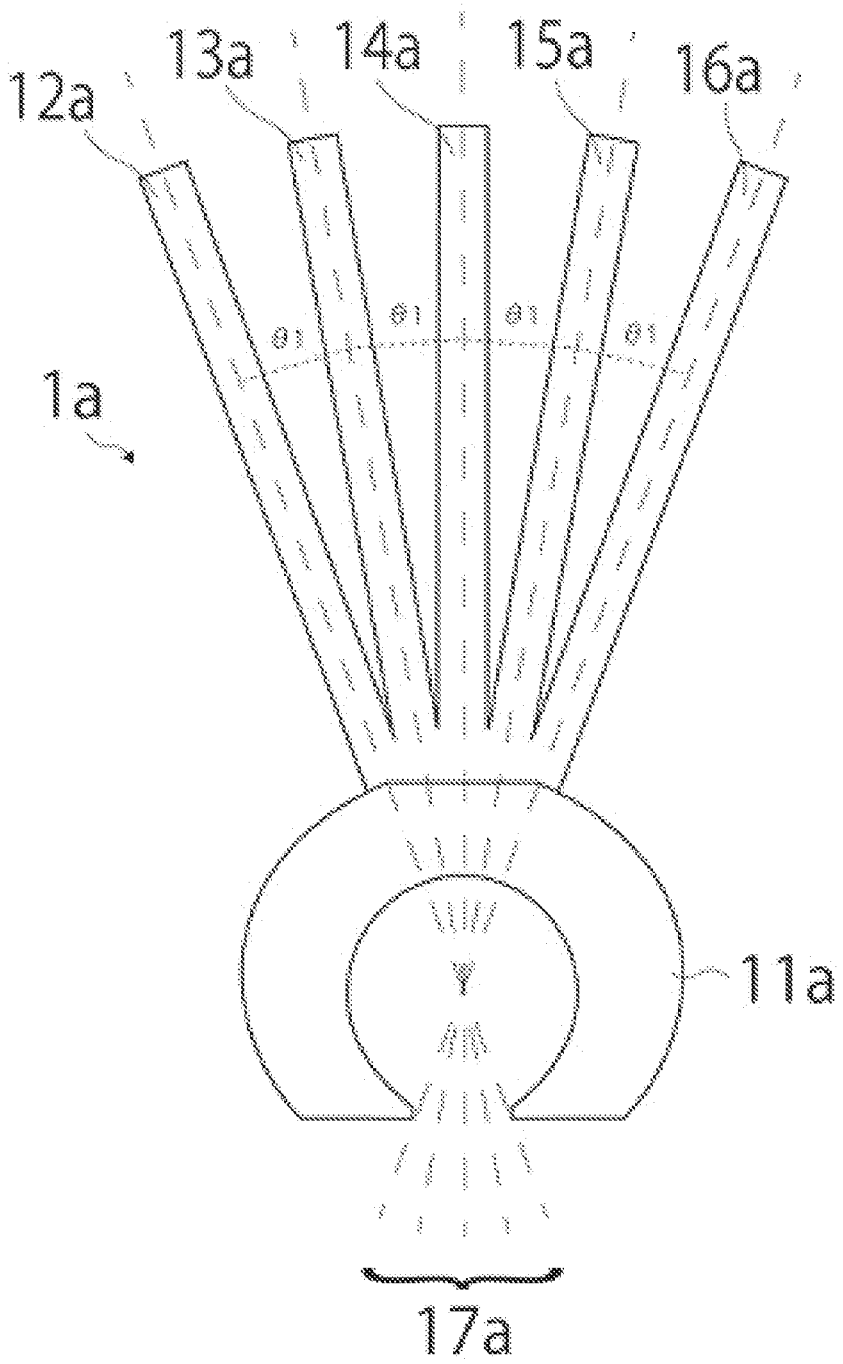
FIG. 15 is a front view of the golf practice tool with five shaft parts, unlike the first embodiment of the present invention.
Figure 16:
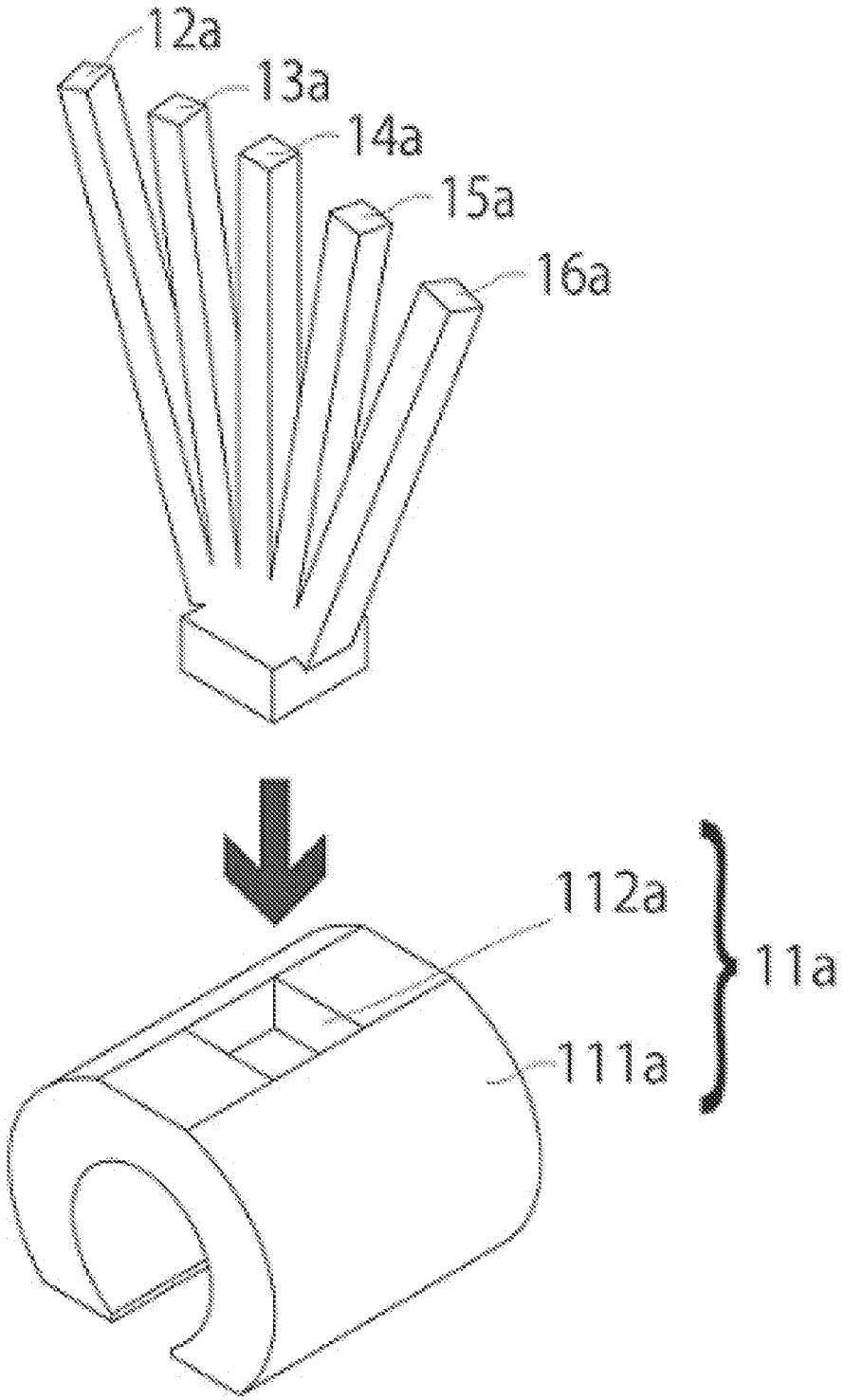
FIG. 16 is an exploded view of the golf practice tool with five shaft parts, unlike the first embodiment of the invention.

In the first and second embodiment described above, although one shaft part is configured, it may have multiple shaft parts (e.g, five shaft parts). Specifically, as shown in FIG. 15, the golf practice tool may be provided such that the central shaft 14*a* of the five shafts is perpendicular to the longitudinal direction of the shaft, and the five shafts are on the same plane, the angular difference from the center line 17*a* of the five adjacent shafts, for example, θ1 (θ1=10 degrees) each. It is possible to adjust the posture and swing by using a different shaft as a new indicator from the specific shaft that was used as an indicator without a bother to rotate the fixing part. In this case, as shown in FIG. 15, the center lines 17*a* of each of the five shaft parts intersect at the center of the diameter of the opening of the C-shaped inner surface of the pincer portion 111*a*, which coincides with the center of gravity of the shaft when the training tool 1*a* is attached to the shaft. As shown in FIG. 16, the fixing part 11*a* consists of a pincer portion 111*a* and a bearing portion 112*a*. At the center of the other end face of the fixing part 11*a*, opposite the side where the pincer portion 111*a* is formed, is a groove, bearing portion 112*a*, for mounting the five shaft parts 12*a* to 16*a*, the lower parts of the five shafts 12*a*-16*a* are square prismatic and can be pushed into the bearing 112*a* and fitted perpendicular to the plane of the push-in to form a single unit. The thickness (width) of the five shafts is, for example, about 3 mm, and the shape of the five shafts is, for example, a square prism shape.

In addition, the golf practice tool may be integrally formed with the golf club.

This application is based on JP Patent Application No. 2020-199940 filed by the applicant in Japan on Dec. 1, 2020, the entire contents of which are incorporated by reference into this application.

INDUSTRIAL AVAILABILITY

The golf practice tool of the present invention enables users to derive the proper golf club positioning (address) and swing form without spending an enormous amount of practice time and practice volume without having to go to the actual golf course, as long as they have a space where they can swing a golf club. As a result, it is industrially useful because the face of the club head and the golf ball hit each other accurately, and the optimal feeling of the shot is acquired, thereby reducing the number of shots and improving the score.

REFERENCE SIGNS LIST

1, 1*a* . . . golf practice tool, 11, 11*a* . . . fixing part, 12, 12*a*, 13*a*, 14*a*, 15*a*, 16*a* . . . shaft part, 17*a* . . . center line of each shaft part, 111, 111*a* . . . pincer portion, 112, 112*a* . . . bearing portion, 21 . . . club head, 22 . . . shaft, 23 . . . grip, 24 . . . sole line, 27 . . . center of gravity of the entire golf club on the shaft, 28 . . . center of gravity of the entire golf club on the club head, 29 . . . ground, 31 . . . A vertical up-down line from the center of gravity of the entire golf club on the shaft when the longitudinal direction of the shaft of the golf club is horizontal, 32 . . . A vertical up-down line from the center of gravity of the entire golf club on the club head when the longitudinal direction of the shaft of the golf club is perpendicular to the ground, 33 . . . the core of a golf club.

What is claimed is:

1. A golf practice tool configured for attachment to a center of gravity of an entire golf club on a shaft of the golf club, the golf practice tool comprising:

a fixing part configured for attaching to the golf club shaft, and multiple shaft parts that fit into a single bearing portion of the fixing part, when the tool is attached to the golf club a center shaft part in a center of the multiple shaft parts is perpendicular to a longitudinal direction of the golf club shaft, the multiple shaft parts are on a same plane, and an angle between center lines of adjacent multiple shaft parts is a constant predetermined angle, the golf practice tool configured such that when attached to the golf club shaft at the center of gravity of the golf club, one end of the center shaft part that is opposite to the bearing portion is approximately located at a core of the golf club.

* * * * *